US005131765A

United States Patent [19]

Bradley et al.

[11] Patent Number: 5,131,765

[45] Date of Patent: Jul. 21, 1992

[54] PRINTER HAVING PRINTHEAD GAP ADJUSTMENT MECHANISM

[75] Inventors: John P. Bradley, Versailles; Johnnie A. Coffey, Georgetown; Clifford M. Denny; Selahattin A. Okcuoglu, both of Lexington, all of Ky.

[73] Assignee: Lexmark International, Inc., Greenwich, Conn.

[21] Appl. No.: 348,118

[22] Filed: May 4, 1989

Related U.S. Application Data

[63] Continuation of Ser. No. 179,096, Apr. 8, 1988, abandoned.

[51] Int. Cl.[5] ..... B41J 11/20

[52] U.S. Cl. ..... 400/55; 400/59; 400/355

[58] Field of Search ..... 400/55-59, 400/355

[56] References Cited

U.S. PATENT DOCUMENTS

| | | | |
|---|---|---|---|
| 4,023,662 | 5/1977 | Perucca | 197/1 R |
| 4,134,692 | 1/1979 | Suzuki et al. | 400/57 |
| 4,233,895 | 11/1980 | Wehler | 400/57 |
| 4,261,039 | 4/1981 | Baker et al. | 400/57 |
| 4,268,177 | 5/1981 | Veale | 400/55 |
| 4,278,020 | 7/1981 | Oaten | 400/57 |
| 4,280,767 | 7/1981 | Heath | 400/216.2 |
| 4,390,292 | 6/1983 | Krenz | 400/57 |
| 4,609,294 | 9/1986 | Gomoll et al. | 400/57 |
| 4,652,153 | 3/1987 | Kotsuzumi et al. | 400/57 |
| 4,657,415 | 4/1987 | Kikuchi et al. | 400/59 |
| 4,676,675 | 6/1987 | Suzuki et al. | 400/56 |
| 4,729,676 | 3/1988 | Smith et al. | 400/196.1 |
| 4,738,552 | 4/1988 | Kikuchi et al. | 400/59 |
| 4,812,059 | 3/1989 | Masaki | 400/59 |
| 4,897,670 | 1/1990 | Hasegawa | 400/55 |

FOREIGN PATENT DOCUMENTS

| | | | |
|---|---|---|---|
| 2294854 | 12/1975 | France . | |
| 2409156 | 11/1978 | France . | |
| 0096868 | 6/1982 | Japan | 400/57 |
| 164174 | 9/1984 | Japan . | |

OTHER PUBLICATIONS

Computer Systems Reviews, Jan. 1988, No. 1 "Optional Extras", p. 40.

*Primary Examiner*—Edgar S. Burr
*Assistant Examiner*—John S. Hilten
*Attorney, Agent, or Firm*—Frank C. Leach, Jr.; John A. Brady

[57] ABSTRACT

A dot matrix printhead is adjusted automatically or manually with respect to a platen in accordance with the thickness of a recording medium on which printing is to occur. When a host data processor sends a control signal to a printer microprocessor to indicate that a recording medium of a different thickness is to be printed, a carrier, which has a first portion supporting the printhead and pivotally and slidably mounted on a front guide rail, is moved so that a shift arm on the carrier engages a right side plate of the frame. This disconnects a ribbon drive motor gear from a ribbon drive gear and moves the ribbon drive motor gear into engagement with a gear train. Rotation of the gear train rotates a gear, which has a threaded shaft and is rotatably supported by a second portion of the carrier slidably mounted on a rear guide rail, to cause pivoting of the first portion of the carrier about the front guide rail to change the gap of the printhead from the platen. When the gap change is completed, the carrier is moved to the left to its recording medium loading printing position and to disengage the ribbon drive motor gear from the gear train and reengage it with the ribbon drive gear. Then, manual adjustment of the spacing of the printhead from the platen may be accomplished.

20 Claims, 7 Drawing Sheets

PRINTER HAVING PRINTHEAD GAP ADJUSTMENT MECHANISM

This is a continuation of application Ser. No. 07/179,096 filed Apr. 8, 1988, now abandoned.

FIELD OF THE INVENTION

This invention relates to a printer having its printhead spaced from its platen in accordance with the thickness of the recording medium on which printing is to occur and, more particularly, to a printer in which the spacing between the printhead and the platen may be adjusted either automatically or manually in accordance with the thickness of the recording medium on which printing is to occur.

BACKGROUND OF THE INVENTION

In a high speed impact printer such as a wire matrix printer, for example, the spacing or gap between a platen and a printhead is very small and critical. For example, the spacing may be between 0.016 inches and 0.032 inches depending upon the thickness of the recording medium on which printing is to occur. A thicker recording medium such as an envelope, for example, would require a greater gap than a single sheet of paper.

When a printer is controlled by a personal computer (PC), a remote control signal from the PC is required to change the gap or spacing between the printhead and the platen when the thickness of the recording medium changes with respect to the prior recording medium on which printing has occurred. This is necessary to insure the desired print quality.

At the same time, it is desired for the printer to be capable of having the gap or spacing between the printhead and the platen to be manually adjusted by a user when the printer is not under control of the PC. This enables a user to have a plurality of selections as to the size of the gap or spacing.

Two previously suggested mechanisms for adjusting the gap or spacing between a printhead and a platen are disclosed in U.S. Pat. No. 4,268,177 to Veale and U.S. Pat. No. 4,657,415 to Kikuchi et al. The mechanism of the aforesaid Veale patent is capable of only manually adjusting the space or gap. While the mechanism of the aforesaid Kikuchi et al patent discloses a manual adjustment of the space or gap, it states that this motion also may be accomplished by activating a solenoid. However, the mechanisms of the aforesaid Veale and Kikuchi et al patents are not capable of having either manual or automatic adjustment of the gap as is required when seeking to remotely control the size of the gap while still enabling a user to manually control the gap size when desired.

SUMMARY OF THE INVENTION

The printer of the present invention satisfactorily solves the foregoing problem through having a mechanism capable of enabling the gap or space between a printhead and a platen to be either automatically or manually adjusted. With automatic adjustment, the printer automatically moves to its maximum gap or space when printing is to be on an envelope or a multipart form in response to a control signal from a host data processor (PC) and to its minimum gap or spacing when printing is to be on a single sheet of paper in response to a control signal from the PC.

The printer of the present invention accomplishes this through utilizing its ribbon drive motor to rotate a gear train to cause movement of a portion of the carrier having the printhead thereon to move the printhead closer or further from the platen. The printer of the present invention also is capable of having the portion of the carrier having the printhead thereon moved through a separate gearing arrangement being manually moved by a handle to activate a portion of the gear train.

An object of this invention is to provide a printer having a mechanism for changing the gap or spacing between a printhead and a platen.

Another object of this invention is to provide a printer in which the gap or spacing between a printhead and a platen may be controlled either automatically or manually.

The foregoing and other objects, features, and advantages of the invention will be apparent from the following more particular description of the preferred embodiment of the invention as illustrated in the accompanying drawings.

DETAILED DESCRIPTION

Figure 1:
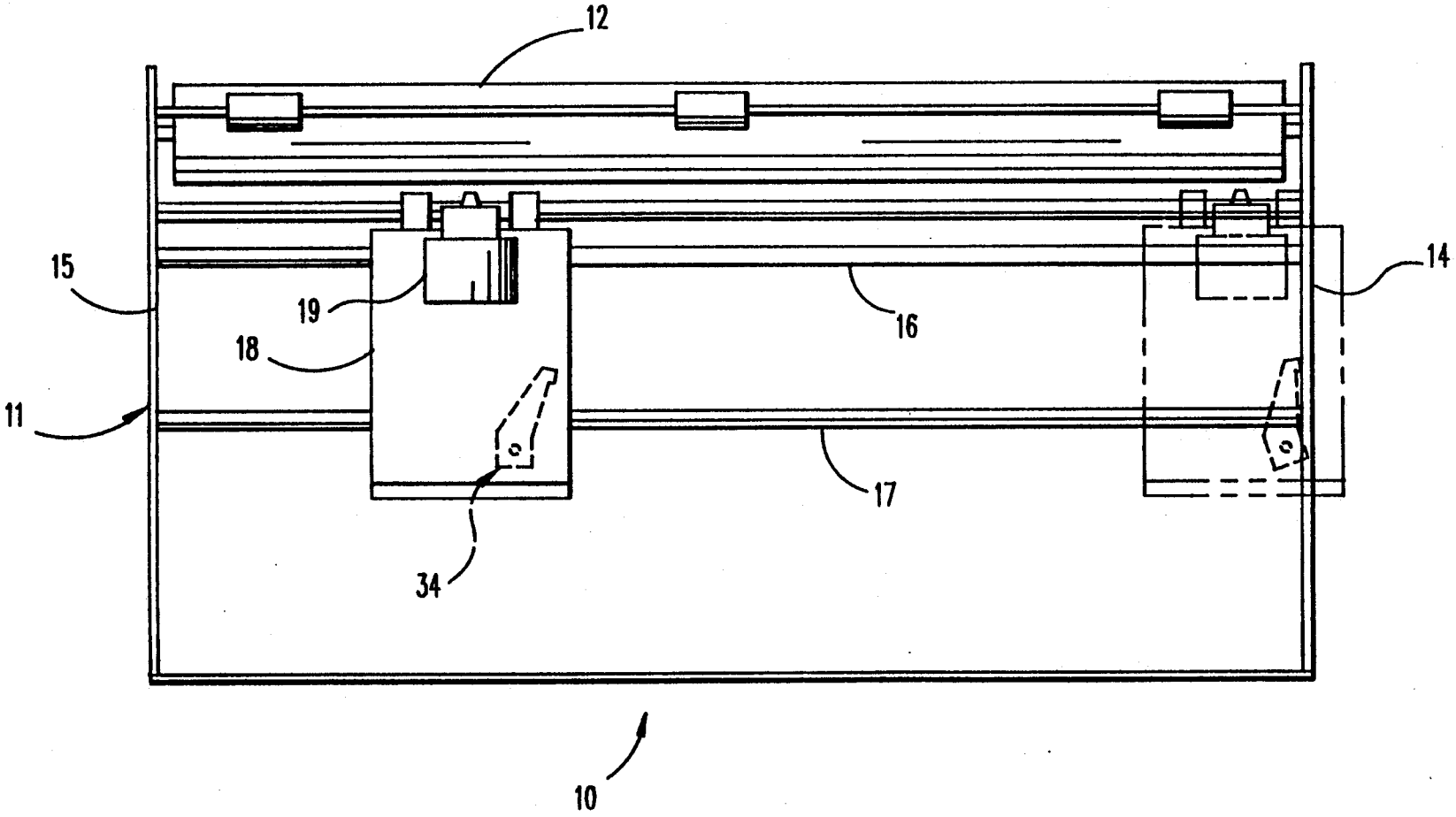
FIG. 1 is a schematic top plan view of a printer having a mechanism for producing automatic or manual adjustment of the gap or space between its printhead and its platen.

Referring to the drawings and particularly FIG. 1, there is shown a printer 10 including a frame 11 rotatably supporting a platen 12. The frame 11 includes a right side plate 14 and a left side plate 15 substantially parallel to each other. A front guide rail 16 extends between the sides plates 14 and 15, and a rear guide rail 17 extends between the side plates 14 and 15. The guide rails 16 and 17, which are parallel to each other, also are parallel to the axis of rotation of the platen 12.

Figure 5:
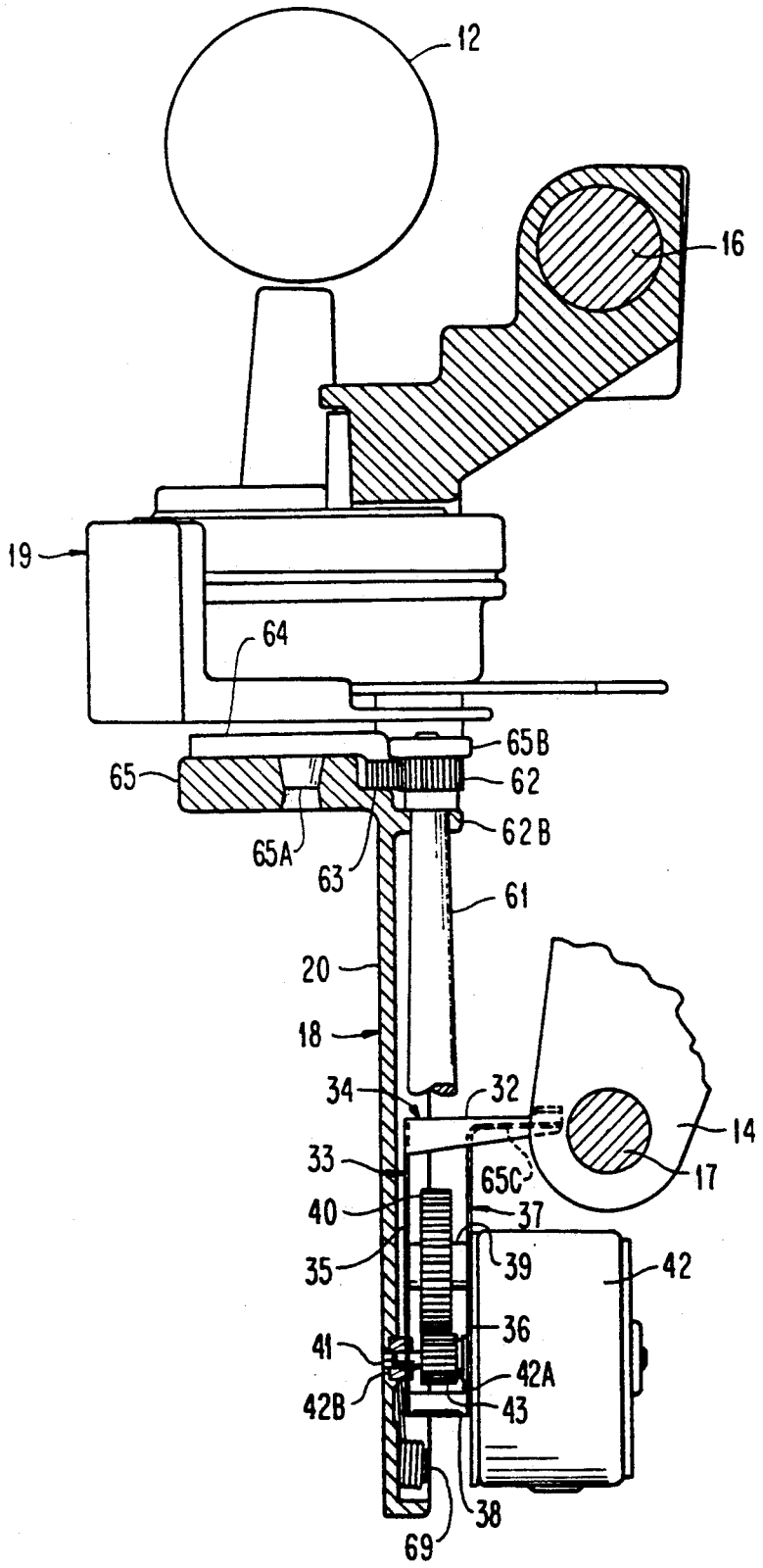
FIG. 5 is a right side elevational view, partly in section, of a portion of the printer of FIG. 3 with additional structure shown and taken along line 5—5 of FIG. 3.
Figure 6:
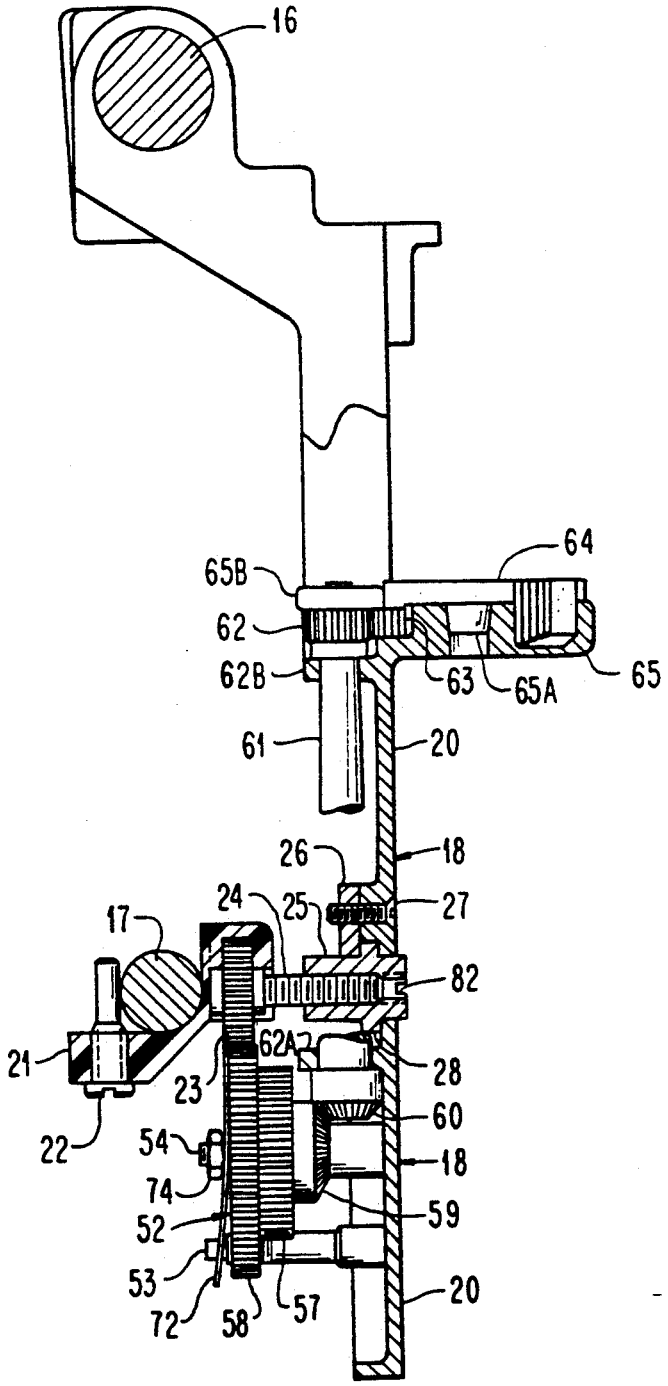
FIG. 6 is a left side elevational view, partly in section, of a portion of the printer of FIG. 3 with additional structure shown and taken along 6—6 of FIG. 3.

A carrier 18, which supports a printhead 19 such as a wire matrix printhead, for example, is slidably supported on the guide rails 16 and 17 for movement thereon between the side plates 14 and 15 by a transport motor (not shown). The carrier 18 includes a first portion 20 (see FIG. 5), which supports the printhead 19 and is slidably supported on the front guide rail 16 for movement parallel to the longitudinal axis of the platen 12. A shoe 21 (see FIG. 6), which constitutes a second portion of the carrier 18, is slidably supported on the rear guide rail 17. A screw 22 holds the shoe 21 on the rear guide rail 17 so that the shoe 21 can only move axially along the rear guide rail 17 and parallel to the longitudinal axis of the platen 12 (see FIG. 1).

The shoe 21 (see FIG. 6) rotatably supports a jacking gear 23, which has twenty-six teeth, having a threaded shaft 24, which is threaded into an adjustment sleeve 25, integral therewith. The adjustment sleeve 25 is attached to the first portion 20 of the carrier 18 by a locking tab 26, which is secured to the first portion 20 of the carrier 18 by a locking screw 27, bearing against a flange 28 on the adjustment sleeve 25. Accordingly, the threaded shaft 24 and the adjustment sleeve 25 cooperate to connect the first portion 20 of the carrier 18 and the shoe 21 of the carrier 18 to each other while permitting slight relative movement therebetween to enable changing or adjusting of the spacing of the printhead 19 (see FIG. 5) from the platen 12. Rotation of the jacking gear 23 (see FIG.6) causes pivoting of the first portion 20 of the carrier 18 about the front guide rail 16 to change or adjust the gap or spacing between the printhead 19 (see FIG. 5) and the platen 12.

Figure 2:
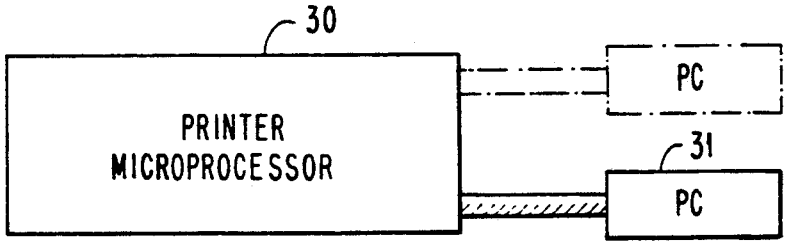
FIG. 2 is block diagram showing the relation between a host data processor and a printer microprocessor.

Automatic adjustment of the gap between the printhead 19 and the platen 12 is only performed when the printer 10 (see FIG. 1) is used with a dual bin automatic sheet feeder with an optional envelope bin installed. When the printer 10 is initially turned on, a printer microprocessor 30 (see FIG. 2) checks the options port to determine if the dual bin automatic sheet feeder with the optional envelope bin is installed. If it is, the printer microprocessor 30 causes the gap between the printhead 19 (see FIG. 5) and the platen 12 to be set to the default position for a sheet of paper, specified by a user by settings of switches, during the initialization process. No automatic change of the gap between the printhead 19 and the platen 12 is made until the control signal (select sheet feed option) is received from a PC 31 (see FIG. 2) and the printer microprocessor 30 is instructed from the PC 31 to load a recording medium such as a sheet of paper or an envelope. At that time, the gap between the printhead 19 (see FIG. 5) and the platen 12 is set to the default setting for the option selected. The gap remains at its setting until a new control signal is received from the PC 31 (see FIG. 2). Whenever a recording medium of an increased thickness such as an envelope, for example, is to be positioned on the platen 12 (see FIG. 5) for printing from the printhead 19 after a thinner recording medium such as a sheet of paper, for example, has been positioned on the platen 12, the jacking gear 23 (see FIG. 6) is automatically rotated to shift the first portion 20 of the carrier 18 relative to the shoe 21 to increase the gap or space between the platen 12 (see FIG. 5) and the printhead 19. A control signal is supplied from the PC 31 (see FIG. 2), which comprises a host data processor, to the microprocessor 30 of the printer 10 (see FIG. 1). The printer 10 may be utilized with additional PCs besides the PC 31 (see FIG. 2) and one additional PC is shown in phantom in FIG. 2.

When the microprocessor 30 receives the control signal from the PC 31, the printer microprocessor 30 causes the carrier 18 (see FIG. 1) to move along the guide rails 16 and 17 towards the right side plate 14 of the frame 11 by activation of the transport motor for the carrier 18. This motion of the carrier 18 causes a finger 32 (see FIG. 5) of a first portion 33 of a rotatably mounted shift arm 34 (see FIG. 3) to engage the right side plate 14. This also is shown in phantom in FIG. 1.

The first portion 33 (see FIG. 5) of the shift arm 34 includes a flat portion 35, which is substantially parallel to a flat portion 36 of a second portion 37 of the shift arm 34. A rivet 38 connects the flat portions 35 and 36 to each other. A support stud 39 for a gear 40, which has forty-one teeth, also connects the flat portions 35 and 36 to each other.

The shift arm 34 (see FIG. 3) rotates about the axis of a shaft 41 of a motor 42 (see FIG. 4), which drives a ribbon in a ribbon cartridge (not shown) supported by the first portion 20 of the carrier 18. The flat portion 36 (see FIG. 5) of the second portion 37 of the shift arm 34 is rotatably supported on the outer surface of a bushing 42A on the housing of the motor 42 for the shaft 41. The flat portion 35 of the first portion 33 of the shift arm 34 is rotatably supported on a bushing 42B extending downwardly from the first portion 20 of the carrier 18.

The motor 42 (see FIG. 4), which is supported on the first portion 20 of the carrier 18, has a pinion gear 43, which has twelve teeth, fixed to the shaft 41. The pinion gear 43 is always in engagement with the gear 40 (see FIG. 3) on the shift arm 34. When the shift arm 34 is in the position of FIG. 7, the gear 40 is in engagement with an output pinion gear 44, which has twenty teeth and is rotatably supported on a stud 45 extending downwardly from the first portion 20 of the carrier 18.

The output pinion gear 44 meshes with a ribbon drive gear 46. The ribbon drive gear 46 includes a second ribbon drive gear 47 meshing with a third ribbon drive gear 48, which is supported from the first portion 20 of the carrier 18 by a stud 48A having a gear 48B (see FIG. 4) above the upper surface of the first portion 20 of the carrier 18. The gear 48B advances the ribbon past the print position through driving a gear attached to a spool of the ribbon cartridge, which is supported on the upper surface of the first portion 20 of the carrier 18.

Figure 3:
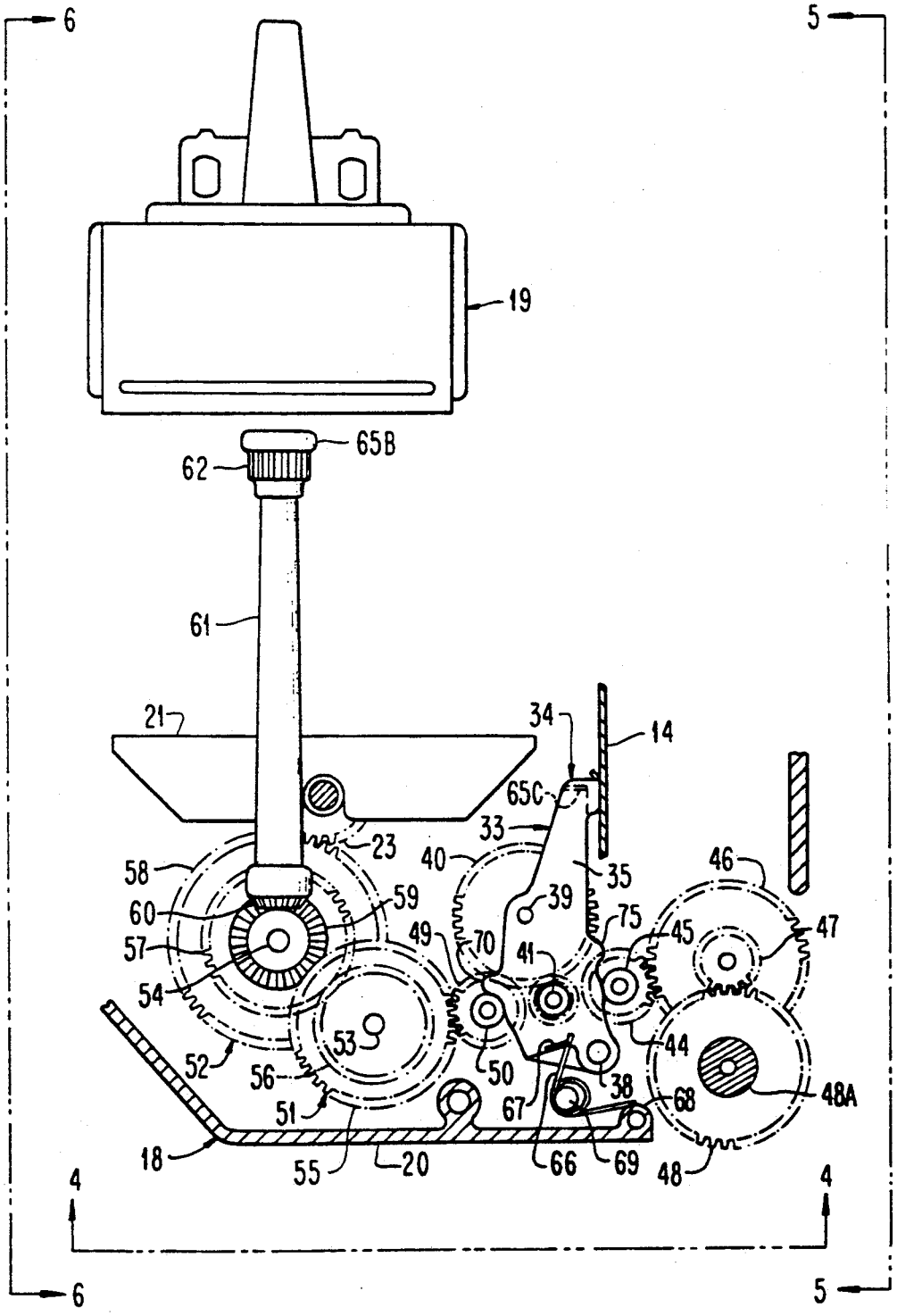
FIG. 3 is a top plan view of a portion of the printer of FIG. 1 in which a gear train is being driven for automatic adjustment of the gap between the printhead and the platen.
Figure 7:
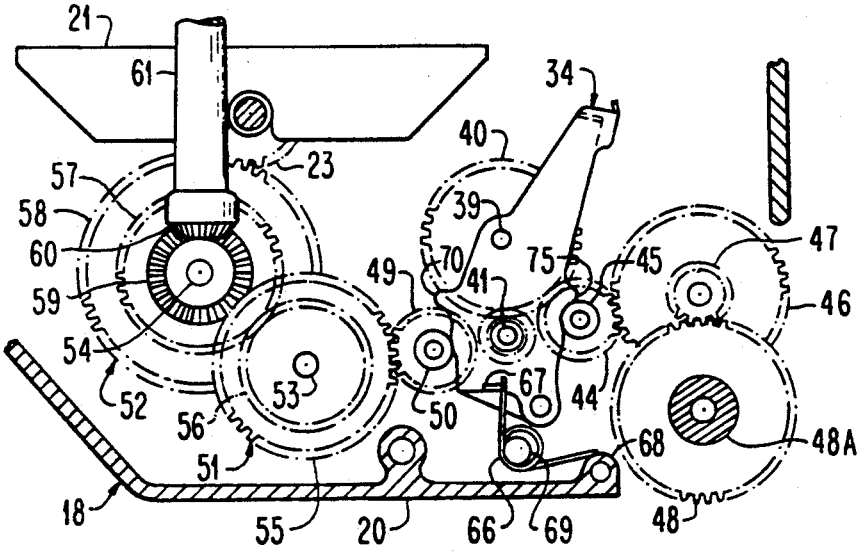
FIG. 7 is a top plan view, similar to a portion of FIG. 3, with the gear train in its position in which manual activation may be accomplished.

When the shift arm 34 (see FIG. 3) engages the right side plate 14, the shift arm 34 rotates counterclockwise about the axis of the motor shaft 41 from the position of FIG. 7 to the position of FIG. 3. This results in the gear 40 meshing with an output pinion gear 49, which is rotatably supported by the first portion 20 of the carrier 18 on a stud 50 extending downwardly from the first portion 20 of the carrier 18. When the gear 40 meshes with the output pinion gear 49, which has twenty teeth, the jacking gear 23 (see FIG. 6) is rotated to cause relative motion of the first portion 20 of the carrier 18 with respect to the shoe 21. This moves the printhead 19 (see FIG. 5) further from the platen 12 to provide the maximum spacing therebetween or the printhead 19 closer to the platen 12 to provide the minimum spacing therebetween depending on the direction of rotation of the motor 42.

The jacking gear 23 (see FIG. 3) is driven from the output pinion gear 49 through a gear train, which includes a compound idler gear 51 and a compound gear 52. The compound idler gear 51 is supported on the first portion 20 of the carrier 18 by a stud 53 (see FIG. 4) extending downwardly therefrom, and the compound gear 52 is supported on the first portion 20 of the carrier 18 by a stud 54 extending downwardly therefrom.

The compound idler gear 51 includes an upper idler gear 55, which has fifty teeth, meshing with the output pinion gear 49. The compound idler gear 51 has a lower idler gear 56, which has thirty-two teeth, meshing with an intermediate gear 57, which has forty-five teeth, of the compound gear 52. The compound gear 52 has its lower gear 58 (see FIG. 6) meshing with the jacking gear 23. Thus, when the output pinion gear 49 (see FIG. 3) is meshing with the gear 40, the jacking gear 23 is rotated.

The compound gear 52 also has an upper bevel gear 59, which has twenty-seven teeth, meshing with a bevel gear 60, which has eighteen teeth, on one end of a shaft 61. The shaft 61 has a spur gear 62, which has seventeen teeth, on its opposite end. The shaft 61 is supported on the first portion 20 of the carrier 18 by journals 62A (see FIG. 6) and 62B adjacent the gears 60 and 62, respectively.

Figure 4:
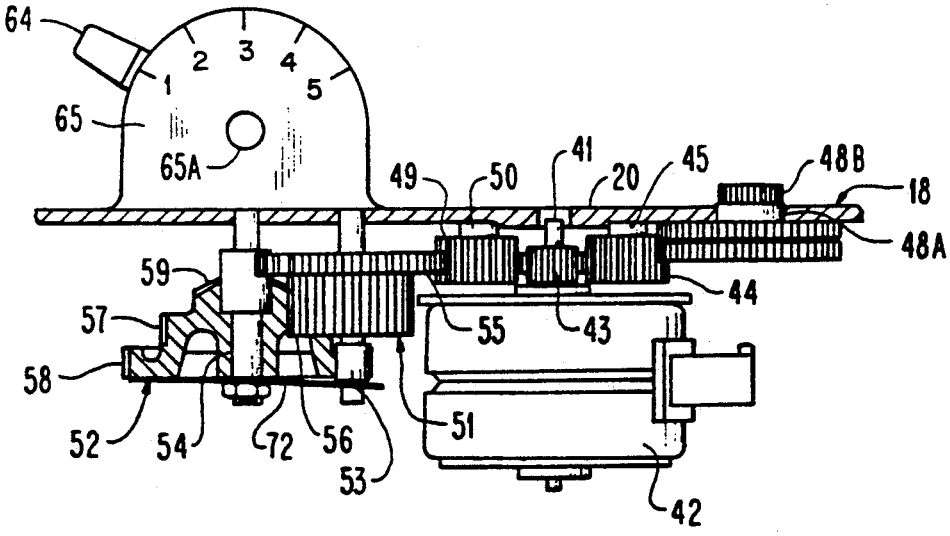
FIG. 4 is a front elevational view of a portion of the printer of FIG. 3 with parts omitted and taken along line 4—4 of FIG. 3.

The gear 62 meshes with a sector gear 63, which has fifty-three teeth, on an inner end of a handle 64. As shown in FIG. 4, the handle 64 cooperates with indicia on an upstanding plate 65, which is integral with the first portion 20 of the carrier 18 and has the handle 64 rotatably mounted thereon by a stud 65A, to indicate the position of the printhead 19 (see FIG. 5) with respect to the platen 12. Thus, position 1 on the plate 65 (see FIG. 4) indicates the minimum gap or spacing between the platen 12 (see FIG. 5) and the printhead 19 while position 5 (see FIG. 4) on the plate 65 identifies the maximum spacing between the platen 12 (see FIG. 5) and the printhead 19. Positions 2, 3, and 4 on the plate 65 (see FIG. 4) indicate gaps intermediate the minimum and maximum gaps.

When the shift arm 34 is in the position of FIG. 7, the handle 64 (see FIG. 6), which is held against the plate 65 by a flange 65B on the end of the shaft 61 bearing against the gear 63 on the inner end of the handle 64, may be grasped by the user to rotate the jacking gear 23 through the gears 63 and 62, the shaft 61, the bevel gears 60 and 59, and the gear 58. Thus, the spacing or gap between the printhead 19 (see FIG. 5) and the platen 12 may be manually adjusted.

When the finger 32 of the first portion 33 (see FIG. 3) of the shift arm 34 engages the right side plate 14 during advancement of the carrier 18 to the right by its transport motor, the finger 32 (see FIG. 5) deflects because the first portion 33 of the shift arm 34 is formed of a resilient metal so that the finger 32 functions as a cantilever spring. The second portion 37 of the shift arm 34 is formed of a substantially rigid metal so that the maximum deflection of the finger 32 is limited by a stop 65C on the second portion 37 of the shift arm 34.

When the finger 32 of the shift arm 34 engages the right side plate 14 so that a counterclockwise (as viewed in FIG. 3) moment is produced on the shift arm 34, the shift arm 34 (see FIG. 3) rotates counterclockwise about the axis of the shaft 41 of the motor 42 (see FIG. 4). A torsion spring 66 (see FIG. 3) resists this counterclockwise motion of the shift arm 34.

One end of the torsion spring 66 acts against one end of a tab 67 of the flat portion 35 of the first portion 33 of the shift arm 34. The torsion spring 66 has its other end acting against a curved surface 68 of the first portion 20 of the carrier 18. The torsion spring 66 has plurality of coils wrapped around a stud 69 extending downwardly from the first portion 20 of the carrier 18.

As the carrier 18 is continued to be advanced towards the right side plate 14 by its transport motor, the shift arm 34 continues to rotate counterclockwise until a point is reached at which this counterclockwise moment, which is produced by the finger 32 (see FIG. 5) of the shift arm 34 engaging the right side plate 14, is greater than the moment produced by the torsion spring 66 (see FIG. 3). When this occurs, the shift arm 34 is rotated counterclockwise until a stop 70 on the shift arm 34 engages the stud 50, which rotatably supports the output pinion gear 49. When this occurs, the gear 40 is meshing with the output pinion gear 49 to cause rotation of the jacking gear 23 through the gear train of the compound idler gear 51-and the compound gear 52 when the motor 42 (see FIG. 4) is energized.

The stop 70 (see FIG. 3) and the stud 50 insure proper meshing center distance between the gears 40 and 49 to avoid a hard engagement between the teeth of the gears 40 and 49 when the shift arm 34 rotates counterclockwise. The spring rates of the finger 32 (see FIG. 5) and the torsion spring 66 (see FIG. 3) are selected to prevent impact of the stop 70 on the stud 50 when there is counterclockwise rotation of the shift arm 34.

When the shift arm 34 is in the activated position of FIG. 3, the restoring moment from the torsion spring 66 on the shift arm 34 is less than the initial moment because the distance from the force being applied by the torsion spring 66 in the activated position of FIG. 3 to the axis of the shaft 41 of the motor 42 (see FIG. 4) is less than the distance when the shift arm 34 (see FIG. 7) is in its inactivated position of FIG. 7. Therefore, less force is required to maintain the shift arm 34 in its activated position of FIG. 3 than is required to move the shift arm 34 from its inactivated position of FIG. 7 to its activated position of FIG. 3. This enables the transport motor for the carrier 18 to have a very low current when it is stalled at the time that the shift arm 34 is in its activated position of FIG. 3. By making the current to the transport motor for the carrier 18 as low as possible when it is stalled, heating of the transport motor is decreased.

Because the transport motor of the carrier 18 is the source of force to mitigate against the restoring moment of the torsion spring 66, the transport motor for the carrier 18 can have a very low holding current at this time because the restoring moment is relatively low when the shift arm 34 is in its activated position. While the transport back-drive friction, which is the friction that must be overcome to push the carrier 18 away from the right side plate 14, is almost sufficient to hold the carrier 18 against the right side plate 14, the holding of the carrier 18 against the right side plate 14 should not depend solely upon this friction. Accordingly, the transport motor for the carrier 18 should draw a little current to insure that the carrier 18 remains in the position in which the shift arm 34 is in its activated position.

Figure 8:
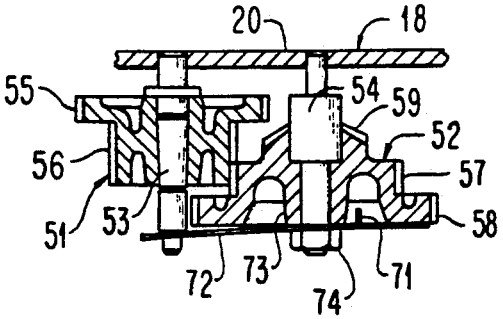
FIG. 8 is a fragmentary sectional view of a portion of the gear train of FIG. 3 and showing a detent arrangement for retaining the gear train in the position to which it is moved.

When the gear 40 is meshing with the output pinion gear 49 and the motor 42 (see FIG. 4) is energized, rotation of the compound gear 52 continues until a tab 71 (see FIG. 8) of a flat detent spring 72 is engaged by one of the ends of an arcuate slot 73 (see FIG. 9) in the bottom of the compound gear 52. The detent spring 72 is fixed to the stud 54 by a nut 74 and freely supported on the stud 53.

The motor 42 (see FIG. 4) is energized for a sufficient period of time to insure that the compound gear 52 can be rotated from the position in which one end of the arcuate slot 73 (see FIG. 9) engages the tab 71 until the other end of the arcuate slot 73 engages the tab 71. When the motor 42 (see FIG. 4) is energized after the shift arm 34 is in its activated position of FIG. 3 and the shaft 41 of the motor 42 (see FIG. 4) has rotated clockwise (as viewed in FIG. 3) to increase the gap between the printhead 19 (see FIG. 5) and the platen 12 to its maximum, there is a reaction torque on the shift arm 34 (see FIG. 3) to try to drive the shift arm 34 clockwise to disengage the gear 40 from the output pinion gear 49. The motor 42 (see FIG. 4) is turned under control of the printer microprocessor 30 (see FIG. 2) when the carrier 18 (see FIG. 3) ceases to move because of the shift arm 34 engaging the right side plate 14.

Figure 9:
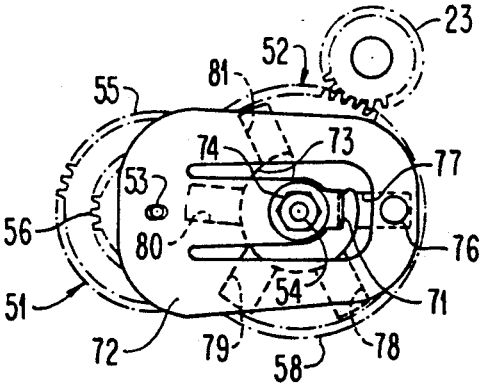
FIG. 9 is a bottom plan view of the portion of the gear train of FIG. 8.

When the tab 71 (see FIG. 9) is engaged by one end of the arcuate slot 73 to stop further rotation of the compound gear 52 by the motor 42 (see FIG. 4), this reaction torque on the shift arm 34 (see FIG. 3) to disengage the gear 40 from the output pinion gear 49 is the highest and the motor 42 (see FIG. 4) is stalled. When this occurs, the shift arm 34 (see FIG. 3) attempts to rotate clockwise and overcome the holding force of the finger 32 (see FIG. 5) against the right side plate 14 by causing it to deflect. However, this deflection is limited by the stop 65C on the second portion 37 of the shift arm 34. This constrains the shift arm 34 from further rotation so that the gear 40 (see FIG. 3) cannot disengage completely from the output pinion gear 49 when the motor 42 (see FIG. 4) is stalled. When the shaft 41 of the motor 42 is rotated counterclockwise (as viewed in FIG. 3) to move the printhead 19 (see FIG. 5) relative to the platen 12 so that there is a minimum gap therebetween and to position one end of the arcuate slot 73 (see FIG. 9) in engagement with the tab 71 as shown in FIG. 9, the stall of the motor 42 (see FIG. 4) does not present a problem because the reaction torque on the shift arm 34 (see FIG. 3) aids in engaging the gear 40 with the output pinion gear 49.

After the gap between the platen 12 (see FIG. 5) and the printhead 19 has been set at the maximum, for example, through having moved the carrier 18 (see FIG. 3) so that the shift arm 34 has engaged the right side plate 14 to cause counterclockwise rotation of the shift arm 34 and then energization of the motor 42 (see FIG. 4), the transport motor for the carrier 18 moves the carrier 18 away from the right side plate 14 (see FIG. 3). With this removal of the force on the finger 32 (see FIG. 5) of the shift arm 34, there is enough restoring moment from the torsion spring 66 (see FIG. 3) on the shift arm 34 to begin the unresisted clockwise rotation of the shift arm 34. This clockwise rotation of the shift arm 34 ceases when a stop 75 on the shift arm 34 engages the stud 45 for the output pinion gear 44 as shown in FIG. 7.

During driving of the ribbon by the motor 42 (see FIG. 4), the shift arm 34 (see FIG. 7) is in its inactivated position so that the gear 40 is in mesh with the output pinion gear 44 to drive the ribbon. At this time, the holding moment from the torsion spring 66 on the shift arm 34 is a maximum. The shaft 41 of the motor 42 (see FIG. 4) rotates clockwise (as viewed in FIG. 7) when the ribbon is driven. Thus, the reaction torque on the shift arm 34 (see FIG. 7) from the rotation of the motor 42 (see FIG. 4) aids in maintaining meshing between the gears 40 (see FIG. 7) and 44.

The printhead 19 (see FIG. 3) is held in any of the positions to which it is moved automatically or manually by a detent mechanism. The detent mechanism includes an upstanding spherical dimple 76 (see FIG. 9) on the end of the flat detent spring 72 remote from its free end fitting on the stud 53. The compound gear 52 has five detent grooves 77, 78, 79, 80, and 81 in its bottom surface for cooperation with the spherical dimple 76 on the flat detent spring 72. The detent groove 77 is adjacent one end of the arcuate slot 73 in the bottom of the compound gear 52, and the detent groove 81 is adjacent the other end of the arcuate slot 73.

As shown on the plate 65 (see FIG. 4), the groove 77 (see FIG. 9) corresponds to position 1 on the plate 65 (see FIG. 4), the groove 78 (see FIG. 9) corresponds to position 2 on the plate 65 (see FIG. 4), the groove 79 (see FIG. 9) corresponds to position 3 on the plate 65 (see FIG. 4), the groove 80 (see FIG. 9) corresponds to position 4 on the plate 65 (see FIG. 4), and the groove 81 (see FIG. 9) corresponds to position 5 on the plate 65 (see FIG. 4). Accordingly, there is a positive retention of the printhead 19 (see FIG. 5) when it is moved to either of the minimum and maximum positions by the activation of the motor 42. There also is positive retention of the printhead 19 in any of the positions to which it is moved manually by the handle 64.

It should be understood that the handle 64 (see FIG. 4) preferably is moved to positions halfway between each adjacent pair of positions 1, 2, 3, 4, and 5 on the plate 65. This would necessitate four additional detent grooves (not shown) being in the bottom surface of the compound gear 52 (see FIG. 9) in addition to the detent grooves 77–81.

The radial distance from the center of the stud 54 to the point of application of the detent force by the spherical dimple 76 on the flat detent spring 72 engaging one of the grooves 77–81 is as large as practical to provide a maximum detent torque. The radius of the spherical dimple 76 is larger than the radius of any of the grooves 77–81 to provide a sharp detent feel when the spherical dimple 76 enters one of the grooves 77–81.

There also is a maximum contact angle between the spherical dimple 76 and each of the grooves 77–81 so that the detent action can be smooth when the spherical dimple 76 enters one of the grooves 77–81 or is removed therefrom. This enables the motor 42 (see FIG. 4) to have sufficient torque output capability to drive the spherical dimple 76 (see FIG. 9) through the grooves 78–80 when moving between the grooves 77 and 81 as the position of the tab 71 is shifted from one end of the arcuate slot 73 to the other end of the arcuate slot 73. When manually moving the handle 64 (see FIG. 4) to shift the first portion 20 (see FIG. 6) of the carrier 18 relative to the shoe 21 to produce a difference in the gap between the printhead 19 (see FIG. 5) and the platen 12, a user can feel the entrance of the spherical dimple 76 (see FIG. 9) into each of the grooves 77–81 whereby the user will stop movement of the handle 64 (see FIG. 4) when the spherical dimple 76 (see FIG. 9) enters the one of the grooves 77–81 corresponding to the position at which the handle 64 (see FIG. 4) is to be disposed.

The initial minimum space or gap between the platen 12 (see FIG. 5) and the printhead 19 is set through loosening the locking screw 27 (see FIG. 6) and turning the adjustment sleeve 25 with a screw driver extending into a slot 82 in the end of the adjustment sleeve 25. Since the threaded shaft 24 is rotationally stationary during this adjustment, the threaded connection of the threaded shaft 24 with the adjustment sleeve 25 draws the threaded shaft 24 up or down into the adjustment sleeve 25 depending on the direction in which the adjustment sleeve 25 is turned. This changes the distance between the shoe 21 and the first portion 20 of the carrier 18 to change the space or gap between the printhead 19 (see FIG. 5) and the platen 12. Then, the locking tab 26 (see FIG. 6) is tightened against the flange 28 of the adjustment sleeve 25 by the locking screw 27.

Considering the operation for changing the gap between the platen 12 (see FIG. 5) and the printhead 19, the PC 31 (see FIG. 2) sends a control signal to the printer microprocessor 30 that a recording medium with a greater thickness such as an envelope, for example, is to be utilized rather than a single sheet of paper or vice versa. If the gap between the platen 12 (see FIG. 5) and the printhead 19 is a minimum, then the control signal would be for a recording medium with a greater thickness whereby the gap between the platen 12 and the printhead 19 will be increased to its maximum.

This control signal to the printer microprocessor 30 (see FIG. 2) causes the transport motor of the carrier 18 (see FIG. 3) to move the carrier 18 to the right until the finger 32 (see FIG. 5) of the shift arm 34 engages the right side plate 14. This produces counterclockwise (as view in FIG. 3) rotation of the shift arm 34 (see FIG. 3) to move the gear 40 into engagement with the output pinion gear 49.

Then, the motor 42 (see FIG. 4) is energized in one direction to cause rotation of the jacking gear 23 (see FIG. 6) to move the first portion 20 of the carrier 18 toward the shoe 21 by pivoting the first portion 20 of the carrier 18 clockwise about the front guide rail 16. The number of pulses to the motor 42 (see FIG. 4), which is a stepping motor, is sufficient to drive the compound gear 52 counterclockwise (as viewed in FIG. 9) until the end of the arcuate slot 73 (see FIG. 9) adjacent the detent groove 81 engages the tab 71.

After the motor 42 (see FIG. 4) completes its activation and is deenergized, the printer microprocessor 30 (see FIG. 2) causes the transport motor for the carrier 18 (see FIG. 3) to move the carrier 18 to the left to its position at which an envelope is loaded. This returns the shift arm 34 to its deactivated position of FIG. 7 so that there is no meshing engagement of the gear 40 with the output pinion gear 49.

When printing of the envelopes, for example is completed and it is desired to return the gap between the platen 12 (see FIG. 5) and the printhead 19 to its minimum, the PC 31 (see FIG. 2) sends a control signal to the printer microprocessor 30. This results in the transport motor for the carrier 18 (see FIG. 3) moving the carrier 18 to the right until the finger 32 (see FIG. 5) of the shift arm 34 engages the right side plate 14. When this occurs, the shift arm 34 rotates counterclockwise (as viewed in FIG. 3) to engage the gear 40 (see FIG. 3) with the output pinion gear 49. At this time, the motor 42 (see FIG. 4) is energized for rotation in the opposite direction to rotate the compound gear 52 (see FIG. 9) clockwise (the opposite direction from that for producing a maximum gap) until the end of the arcuate slot 73 adjacent the detent groove 77 engages the tab 71 on the flat detent spring 72 as shown in FIG. 9.

After completion of clockwise rotation of the compound gear 52 to the position in which the gap between the platen 12 (see FIG. 5) and the printhead 19 is a minimum, the printer microprocessor 30 (see FIG. 2) causes energization of the transport motor for the carrier 18 (see FIG. 3) to move the carrier 18 to the left away from the right side plate 14. The carrier 18 is returned to the position at which a sheet of paper is loaded.

Whenever the compound gear 52 is not being driven by the motor 42 (see FIG. 4), a user may change the gap between the platen 12 (see FIG. 5) and the printhead 19 through manually rotating the handle 64 (see FIG. 4) to any of its other four positions. The spherical dimple 76 (see FIG. 9) on the flat detent spring 72 will be disposed in one of the other of the detent grooves 78–81 when the spherical dimple 76 is in the detent groove 77.

Figure 10:
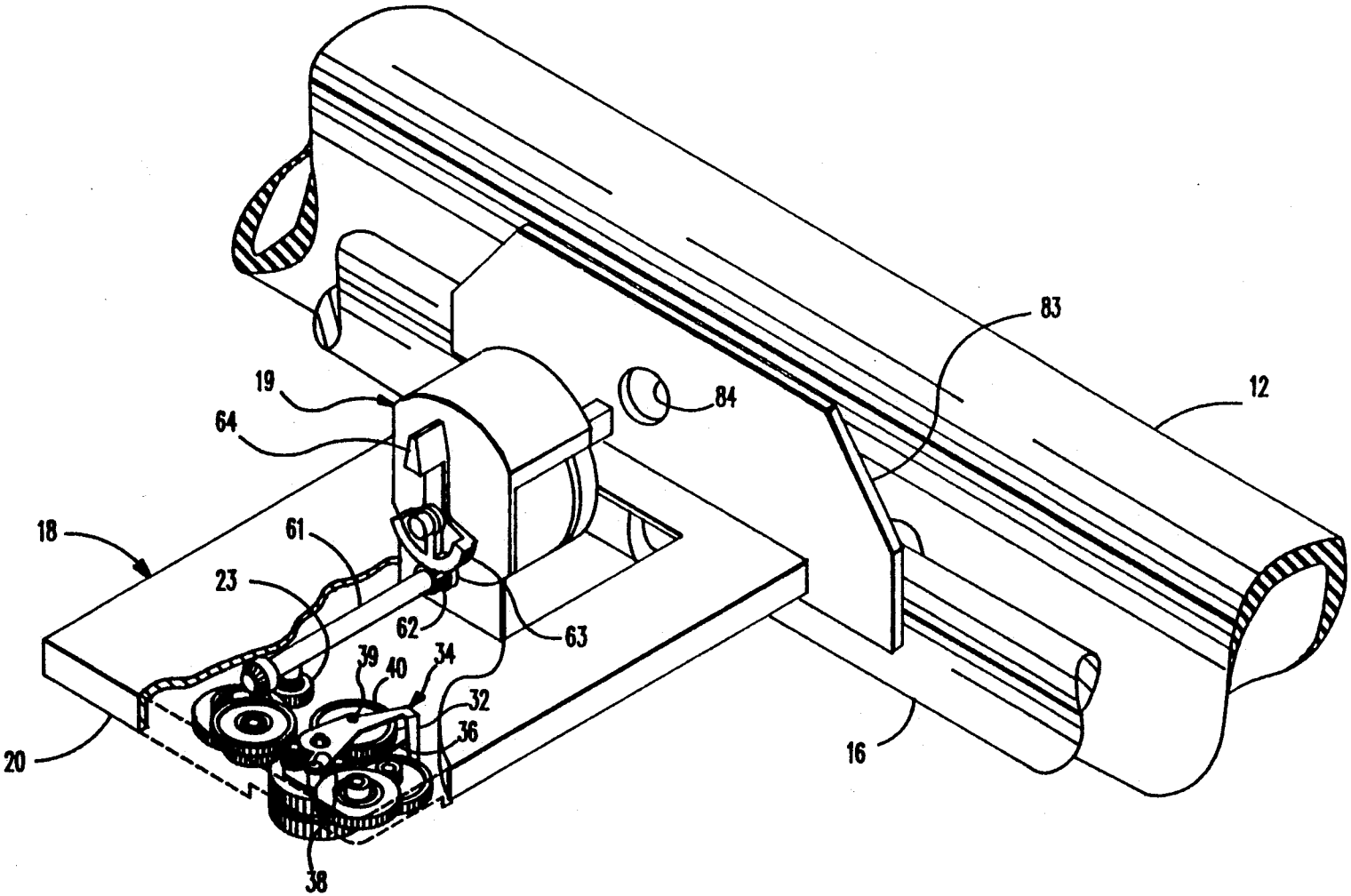
FIG. 10 is an enlarged perspective view of a portion of the printer of FIG. 1 including a gear train used to change the gap between the printhead and the platen.

The first portion 20 (see FIG. 10) of the carrier 18 has a card holder 83 mounted thereon adjacent the platen 12 to position the recording medium wrapped around the platen 12. The card holder 83 has an opening 84 for the wires of the printhead 19 to pass through and engage the recording medium to print thereon.

It should be understood that the number of pulses to the motor 42 (see FIG. 4) for rotating the jacking gear 23 (see FIG. 6) could be other than the number for rotating the jacking gear 23 to pivot the first portion 20 of the carrier 18 between the positions producing the minimum and maximum gaps between the platen 12 (see FIG. 5) and the printhead 19. This would enable automatic positioning of the gap or spacing between the platen 12 and the printhead 19 to intermediate positions such as those identified as positions 2, 3, and 4 on the plate 65 (see FIG. 4). This would be controlled by the control signal from the PC 31 (see FIG. 2).

While the carrier 18 (see FIG. 5) has been shown and described as being moved relative to the platen 12 in directions parallel to the longitudinal axis of the platen 12, it should be understood that the platen 12 could be movable along its longitudinal axis and the carrier 18 would be stationary. It is only necessary that there be relative motion between the platen 12 and the printhead 19 to produce printing along each line of a recording medium supported by the platen 12.

An advantage of this invention is that the gap between a printhead and a platen may be automatically changed when the thickness of the recording medium changes. Another advantage of this invention is that it enables a printer which is used with at least one PC to have its gap between the platen and the printhead automatically set in response to a control signal from the PC. A further advantage of this invention is that the gap or spacing between a platen and a printhead of a printer may be set either automatically or manually.

While the invention has been particularly shown and described with reference to a preferred embodiment thereof, it will be understood by those skilled in the art that the foregoing and other changes in form and details may be made therein without departing from the spirit and scope of the invention.

What is claimed is:

1. A printer including:

a frame;

a platen supported by said frame, said platen supporting a recording medium to be printed upon;

a printhead for printing on the recording medium supported by said platen;

printhead support means for supporting said printhead, said printhead support means being supported by said frame;

one of said printhead support means and said platen being movable relative to the other along the longitudinal axis of said platen to create relative movement between said printhead and said platen for printing on the recording medium;

adjustable means for positioning said printhead toward and away from said platen for adjusting a gap between said printhead and said platen in accordance with the thickness of the recording medium on which printing is to occur;

and responsive means for responding to predetermined control signals defining selection of the recording medium upon which data is to be printed by said printer from a separate host data processor wherein one of the predetermined control signals is unique to a first size gap between said printhead and said platen and at least one other of the predetermined control signals is unique to a second size gap, different from the first size gap, between said printhead and said platen for controlling said adjustable means to select the gap between said printhead and said platen for printing.

2. The printer according to claim 1 including:

pivotal supporting means for pivotal support of said printhead support means by said frame; and said adjustable means including actuating means for pivoting said printhead support means to position said printhead toward and away from said platen for adjusting the gap between said printhead and said platen.

3. The printer according to claim 2 including:

a first guide rail and a second guide rail mounted parallel to each other and to the longitudinal axis of said platen, said first and second guide rails being supported by said frame;

said platen being fixed against movement in a direction parallel to its longitudinal axis and to said first and second guide rails;

said printhead support means including:

a first portion slidably mounted on said first guide rail and supporting said printhead;

and a second portion slidably mounted on said second guide rail and separate from said first portion;

said pivotal supporting means including means for pivotally mounting said first portion of said printhead support means on said first guide rail; and said actuating means of said adjustable means including means for connecting said first portion of said printhead support means and said second portion of said printhead support means to each other so that said first and second portions of said printhead support means slide together along said first and second guide rails relative to said platen, said connecting means moving said first portion of said printhead support means relative to said second portion of said printhead support means to pivot said first portion of said printhead support means about said first guide rail.

4. The printer according to claim 3 including:

said responsive means being ineffective when not responding to the predetermined control signals from the separate host data processor;

and manual control means for manually controlling said adjustable means when said responsive means is ineffective.

5. The printer according to claim 4 in which:

said connecting means of said actuating means of said adjustable means includes a threaded shaft engaged with one of said first and second portions of said printhead support means, said threaded shaft being supported by the other of said first and second portions of said printhead support means; and said actuating means of said adjustable means includes means for rotating said threaded shaft in a selected direction and a selected distance to pivot said first portion of said printhead support means about said first guide rail relative to said second portion of said printhead support means to select the gap between said printhead and said platen for printing in accordance with the thickness of the recording medium on which printing is to occur.

6. The printer according to claim 3 in which:

said connecting means of said actuating means of said adjustable means includes a threaded shaft engaged with one of said first and second portions of said printhead support means, said threaded shaft being supported by the other of said first and second portions of said printhead support means;

and said actuating means of said adjustable means includes means for rotating said threaded shaft in a selected direction and a selected distance to pivot said first portion of said printhead support means about said first guide rail relative to said second portion of said printhead support means to select the gap between said printhead and said platen for printing in accordance with the thickness of the recording medium on which printing is to occur.

7. The printer according to claim 2 including:

said responsive means being ineffective when not responding to the predetermined control signals from the separate host data processor;

and manual control means for manually controlling said adjustable means when said responsive means is ineffective.

8. The printer according to claim 2 in which:

said printhead support means includes:

a first portion supporting said printhead;

and a second portion separate from said first portion;

said pivotal supporting means pivotally mounting said first portion of said printhead support means for pivotal support said frame;

said actuating means of said adjustable means includes means for connecting said first portion of said printhead support means and said second portion of said printhead support means to each other, said connecting means moving said first portion of said printhead support means relative to said second portion of said printhead support means to pivot said first portion of said printhead support means;

said connecting means of said actuating means of said adjustable means includes a threaded shaft engaged with one of said first and second portions of said printhead support means, said threaded shaft being supported by the other of said first and second portions of said printhead support means;

and said actuating means of said adjustable means includes means for rotating said threaded shaft in a selected direction and a selected distance to pivot said first portion of said printhead support means relative to said second portion of said printhead support means to select the gap between said printhead and said platen for printing in accordance with the thickness of the recording medium on which printing is to occur.

9. The printer according to claim 1 including:

a first guide rail and a second guide rail mounted parallel to each other and to the longitudinal axis of said platen, said first and second guide rails being supported by said frame;

said platen being fixed against movement in a direction parallel to its longitudinal axis and to said first and second guide rails; and said printhead support means being slidably mounted on said first and second guide rails for sliding movement relative to said platen.

10. The printer according to claim 9 including:

said responsive means being ineffective when not responding to the predetermined control signals from the separate host data processor;

and manual control means for manually controlling said adjustable means when said responsive means is ineffective.

11. The printer according to claim 1 in which said adjustable means includes:

a threaded shaft engaged with one of said printhead support means and said frame, said threaded shaft being supported by the other of said printhead support means and said frame;

and means for rotating said threaded shaft in a selected direction and a selected distance to move said printhead support means relative to said frame to select the gap between said printhead and said platen for printing in accordance with the thickness of the recording medium on which printing is to occur.

12. The printer according to claim 1 including:

said responsive means being ineffective when not responding to the predetermined control signals from the separate host data processor;

and manual control means for manually controlling said adjustable means when said responsive means is ineffective.

13. A printer including:

a frame;

a platen supported by said frame, said platen supporting a recording medium to be printed upon;

a printhead for printing on the recording medium supported by said platen;

printhead support means for supporting said printhead, said printhead support means being supported by said frame;

one of said printhead support means and said platen being movable relative to the other along the longitudinal axis of said platen to create relative movement between said printhead and said platen for printing on the recording medium;

a threaded shaft engaged with one of said printhead support means and said frame, said threaded shaft being supported by the other of said printhead support means and said frame;

a gear train linked to said threaded shaft for rotating said threaded shaft;

rotating means, separate from said gear train, for rotating said gear train to rotate said threaded shaft an amount sufficiently in a selected direction to move said printhead support means relative to said frame for moving said printhead toward or away from said platen to select the gap between said printhead and said platen for printing in accordance with the thickness of the recording medium on which printing is to occur;

and said rotating means including:

a handle;

a shaft;

a bevel gear;

said handle connected to said shaft on one end of said shaft;

and said bevel gear being mounted on the other end of said shaft and connected to said gear train.

14. The printer according to claim 13 including:

pivotal supporting means for pivotal support of said printhead support means by said frame; and said threaded shaft moving said printhead support means relative to said frame by causing pivoting of said printhead support means.

15. A printer including:

a frame;

a platen supported by said frame, said platen supporting a recording medium to be printed upon;

a printhead for printing on the recording medium supported by said platen;

printhead support means for supporting said printhead, said printhead support means being supported by said frame;

one of said printhead support means and said platen being movable relative to the other along the longitudinal axis of said platen to create relative movement between said printhead and said platen for printing on the recording medium;

a threaded shaft engaged with one of said printhead support means and said frame, said threaded shaft being supported by the other of said printhead support means and said frame;

a gear train linked to said threaded shaft for rotating said threaded shaft;

rotating means, separate from said gear train, for rotating said gear train to rotate said threaded shaft an amount sufficiently in a selected direction to move said printhead support means relative to said frame for moving said printhead toward or away form said platen to select the gap between said printhead and said platen for printing in accordance with the thickness of the recording medium on which printing is to occur;

pivotal supporting means for pivotal support of said printhead support means by said frame;

said threaded shaft moving said printhead support means relative to said frame by causing pivoting of said printhead support means;

and said rotating means including:

non-manual motive means for rotating said gear train;

selective connecting means for selectively connecting said non-manual motive means to said gear train to rotate said gear train a selected amount in a selected direction;

and manual means for rotating said gear train a selected amount in a selected direction when said non-manual motive mans is not connected to said gear train by said selective connecting means.

16. A printer including:

a frame;

a platen supported by said frame, said platen supporting a recording medium to be printed upon;

a printhead for printing on the recording medium supported by said platen;

printhead support means for supporting said printhead, said printhead support means being supported by said frame;

one of said printhead support means and said platen being movable relative to the other along the longitudinal axis of said platen to create relative movement between said printhead and said platen for printing on the recording medium;

a threaded shaft engaged with one of said printhead support mans and said frame, said threaded shaft being supported by the other of said printhead support means and said frame;

a gear train linked to said threaded shaft for rotating said threaded shaft;

rotating means, separate from said gear train, for rotating said gear train to rotate said threaded shaft an amount sufficiently in a selected direction to move said printhead support means relative to said frame for moving said printhead toward or away from said platen to select the gap between said printhead and said platen for printing in accordance with the thickness of the recording medium on which printing is to occur;

and said rotating means including:

non-manual motive means for rotating said gear train;

selective connecting means for selectively connecting said non-manual motive means to said gear train to rotate said gear train a selected amount in a selected direction;

and manual means for rotating said gear train a selected amount in a selected direction when said non-manual motive means is not connected to said gear train by said selective connecting means.

17. A printer including:

a frame;

a platen supported by said frame, said platen supporting a recording medium to be printed upon;

a printhead for printing on the recording medium supported by said platen;

printhead support means for supporting said printhead;

means for supporting said printhead support means on said frame for movement relative thereto to allow said printhead to be moved towards and away from said platen to change the gap between said printhead and said platen;

one of said printhead support means and said platen being movable relative to the other to create relative movement along the longitudinal axis of said platen between said printhead and said platen for printing on the recording medium;

engaging means for engaging with one of said printhead support means and said frame, said engaging means being supported by the other of said printhead support means and said frame;

moving means for moving said engaging means sufficiently to move said printhead support means relative to said frame to select the gap between said printhead and said platen for printing in accordance with the thickness of the recording medium on which printing is to occur;

and said moving means including:

non-manual motive means for driving said engaging means;

selective connecting means for selectively connecting said non-manual motive means to said engaging means to drive said engaging means a selected distance in a selected direction;

and manual means for driving said engaging means a selected distance in a selected direction when said non-manual motive means is not connected to said engaging means by said selective connecting means.

18. The printer according to claim 17 including:

pivotal supporting means for pivotal support of said printhead support means by said frame; and said engaging means moving said printhead support means relative to said frame by causing pivoting of said printhead support means relative to said frame.

19. A printer including:

a frame;

a platen supported by said frame, said platen supporting a recording medium to be printed upon;

a printhead for printing on the recording medium supported by said platen;

printhead support means for supporting said printhead, said printhead support means being supported by said frame;

one of said printhead support means and said platen being movable relative to the other along the longitudinal axis of said platen to create relative movement between said printhead and said platen for printing on the recording medium;

adjustable means for positioning said printhead toward and away from said platen for adjusting a gap between said printhead and said platen in accordance with the thickness of the recording medium on which printing is to occur;

and a microprocessor receiving predetermined control signals defining selection of the recording medium upon which data is to be printed by said printer from a separate host data processor selecting the recording medium on which printing is to occur, one of the predetermined control signals being for a first selected recording medium unique to a firs size gap between said printhead and said platen and at least one other of the predetermined control signals being for a second selected recording medium unique to a second size gap, different from the first size gap, between said printhead and said platen, said microprocessor producing signals in accordance with the predetermined control signals from the separate host data processor to control said adjustable means to select the gap between said printhead and said platen.

20. The printer according to claim 19 including:

pivotal supporting means for pivotal support of said printhead support means by said frame; and said adjustable means including actuating means for pivoting said printhead support means to position said printhead toward and away from said platen for adjusting the gap between said printhead and said platen.

* * * * *